US008816928B2

(12) United States Patent
Weng

(10) Patent No.: US 8,816,928 B2
(45) Date of Patent: Aug. 26, 2014

(54) MULTIBAND ANTENNA

(75) Inventor: Yi-Hsien Weng, Taoyuan (TW)

(73) Assignee: FIH (Hong Kong) Limited, Kowloon (HK)

( * ) Notice: Subject to any disclaimer, the term of this patent is extended or adjusted under 35 U.S.C. 154(b) by 443 days.

(21) Appl. No.: 13/095,741

(22) Filed: Apr. 27, 2011

(65) Prior Publication Data

US 2012/0119970 A1 May 17, 2012

(30) Foreign Application Priority Data

Nov. 15, 2010 (TW) ..... 99139212 A

(51) Int. Cl.
*H01Q 5/01* (2006.01)

(52) U.S. Cl.
USPC ..... 343/843; 343/700 MS; 343/727; 343/900

(58) Field of Classification Search
USPC ..... 343/843, 700 MS, 727, 900
See application file for complete search history.

(56) References Cited

U.S. PATENT DOCUMENTS

| | | | | |
|---|---|---|---|---|
| 2009/0273521 | A1* | 11/2009 | Wong et al. | 343/700 MS |
| 2011/0032166 | A1* | 2/2011 | Zhang et al. | 343/767 |
| 2012/0154253 | A1* | 6/2012 | Ieda et al. | 343/900 |
| 2012/0162035 | A1* | 6/2012 | Jung et al. | 343/727 |

* cited by examiner

*Primary Examiner* — Allyson Trail
(74) *Attorney, Agent, or Firm* — Novak Druce Connolly Bove + Quigg LLP

(57) ABSTRACT

A multiband antenna includes a feeding end, a ground end, and a main body. The main body includes a first radiating path, a second radiating path, a main radiating portion and a transmitting portion. The main radiating portion connected to the feeding end by the first and second radiating paths. The transmitting portion is connected to the main radiating portion and the ground end. The first and second radiating paths, the main radiating portion and the transmitting portion are coplanar.

20 Claims, 3 Drawing Sheets

| Frequency (MHz) | 708 | 824 | 1575 | 1860 |
|---|---|---|---|---|
| Efficiency (%) | 61.49 | 54.49 | 40.52 | 59.34 |

FIG. 3

MULTIBAND ANTENNA

BACKGROUND

1. Technical Field

The disclosure generally relates to antennas, particularly to a multiband antenna.

2. Description of Related Art

Typical portable wireless communication devices generally include a single band antenna to transmit and receive electromagnetic waves. The single band antenna only allows transmission and reception of only one frequency band for communication and does not provide the flexibility of using multiple frequency bands suitable for different communication systems. Theoretically, using a different antenna for each frequency band can solve this problem. However, multiple antennas will inevitably increase the cost of manufacturing the portable wireless communication devices, and occupy a large space within the portable wireless communication devices.

Therefore, there is room for improvement within the art.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure.

FIG. 3 is a table disclosing exemplary radiation efficiencies of the multiband antenna of FIG. 1 at multiple frequencies.

DETAILED DESCRIPTION

Figure 1:
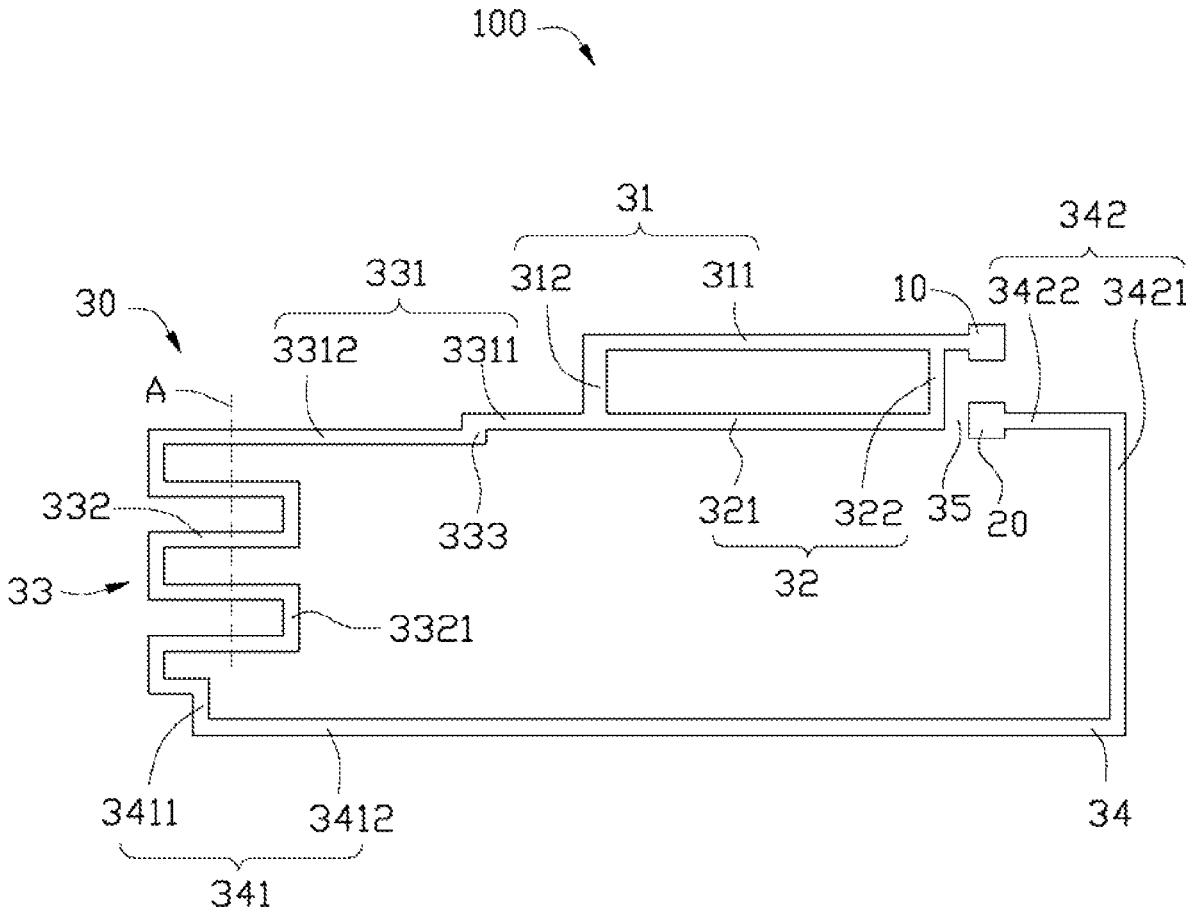
FIG. 1 is a schematic view of a multiband antenna according to an exemplary embodiment, and includes a feeding end, a ground end, and a main body.

FIG. 1 is a schematic view of a multiband antenna 100 according to an exemplary embodiment, and includes a feeding end 10, a ground end 20, and a main body 30. The feeding end 10 and the ground end 20 are formed at two ends of the main body 30. The multiband antenna can be used in a mobile phone or a personal digital assistant, for example.

The main body 30 includes a first radiating path 31, a second radiating path 32, a main radiating portion 33 and a transmitting portion 34. The first radiating path 31, the second radiating path 32, the main radiating portion 33 and the transmitting portion 34 are coplanar and form a substantially rectangular frame.

The first and second radiating paths 31, 32 are substantially L-shaped. The first radiating path 31 includes a first radiating section 311 and a second radiating section 312 perpendicularly connected to the first radiating section 311. The second radiating path 32 includes a third radiating section 321 and a fourth radiating section 322 perpendicularly connected to the third radiating section 321.

The second radiating section 312 is perpendicularly connected to the third radiating section 321. The fourth radiating section 322 is perpendicularly connected to the first radiating section 311. The first radiating section 311 is parallel to the third radiating section 321. The second radiating section 312 is parallel to the fourth radiating section 322. Therefore, the first and second radiating paths 31, 32 form a substantially rectangular frame. In addition, an end of the first radiating section 311 opposite to the second radiating section 312 is served as the feeding end 10 of the multiband antenna 100.

The main radiating portion 33 includes a connecting section 331, and a bent section 332. The connecting section 331 includes a first connecting strip 3311 and a second connecting strip 3312. The first connecting strip 3311 is extended from an end of the third radiating section 321. The second connecting strip 3312 is connected to the bent section 332. The first connecting strip 3311 and the second connecting strip 3312 are combined together. A junction 333 is formed between the first connecting strip 3311 and the second connecting strip 3312.

The bent section 332 is a sheet which extends from the end of the second connecting strip 3312 along a square waveform. The bent section 332 includes a plurality of square wave sections 3321. In this exemplary embodiment, the bent section 332 includes almost two and half square wave sections 3321. The number of the square wave section 3321 can be changed to satisfy different signal transmitting requirements.

The transmitting section 34 includes a first transmitting segment 341 and a second transmitting segment 342. The first and second transmitting segments 341, 342 are substantially L-shaped. The first transmitting segment 341 includes a first end 3411 and a first transmitting strip 3412 perpendicularly connected to the first end 3411. The second transmitting segment 342 includes a second transmitting strip 3421 and a second end 3422 perpendicularly connected to the second transmitting strip 3421.

The first end 3411 is perpendicularly connected to an end of the bent section 332. The first transmitting strip 3412 is perpendicularly connected to the second transmitting strip 3421 and parallel to the second end 3422. The second end 3422 is parallel to the first transmitting strip 3412, and collinear with the fourth radiating section 322. A gap 35 is formed between the second end 3422 and the fourth radiating section 322. The ground end 20 is formed at an end of the second end 3422 and opposite to the feeding end 10.

Figure 2:
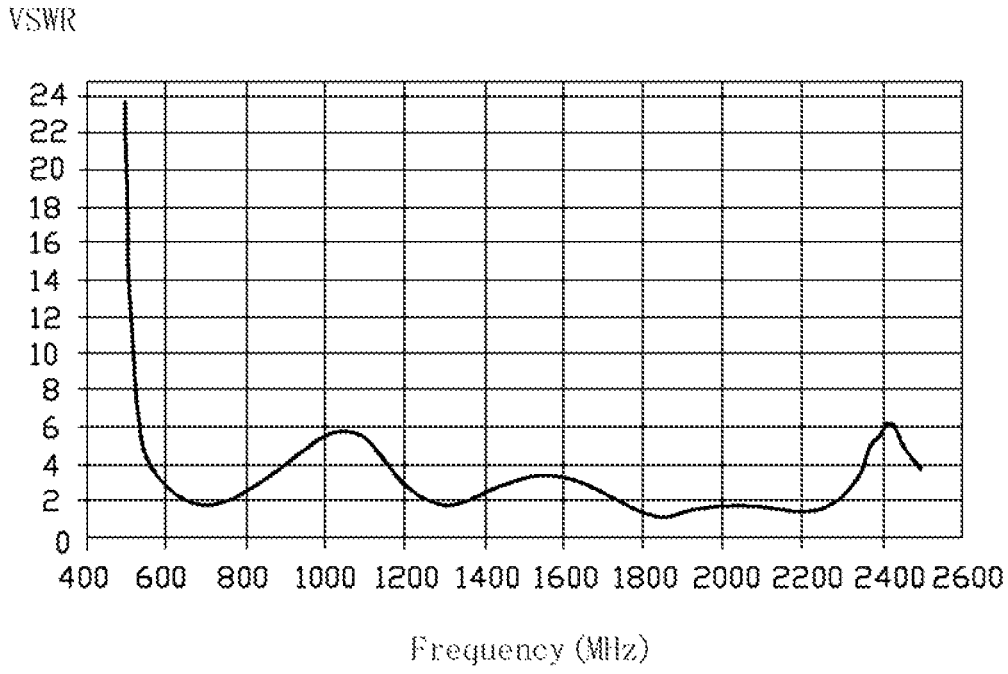
FIG. 2 is an exemplary test graph obtained from the multiband antenna of FIG. 1, disclosing voltage standing wave ratio (VSWR) varying with frequency.

In use, signals fed into the feeding end 10 can be transmitted to the main radiating portion 30 by the first radiating path 10 and the second radiating path 20, and then are radiated by the radiating portion 30. Therefore, the multiband antenna 100 can obtain multiple resonance frequencies. Referring to FIGS. 2 and 3, according to test results, the multiband antenna 100 generates four resonance frequencies of 708 MHz, 824 MHz, 1575 MHz, and 1860 MHz, suitable for working with multiple communication systems.

The structure of the multiband antenna is planar, and does not occupy much space within portable wireless communication devices, which is advantageous to miniaturization of mobile phones. Furthermore, the multiband antenna provides multiple frequency bands suitable for different communication systems, which reduce the cost of the portable wireless communication device, which can work with multiple communication systems.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A multiband antenna, comprising:

a feeding end;

a ground end; and a main body, comprising:

a first radiating path, the first radiating path comprising a first radiating section and a second radiating section perpendicularly connected to the first radiating section; and a second radiating path, the second radiating path comprising a third radiating section and a fourth radiating section perpendicularly connected to the third radiating section;

a main radiating portion connected to the feeding end by the first and second radiating paths; and a transmitting portion connected to the main radiating portion and the ground end; wherein the first and second radiating paths, the main radiating portion and the transmitting portion are coplanar.

2. The multiband antenna as claimed in claim 1, wherein the second radiating section is perpendicularly connected to the third radiating section, the fourth radiating section is perpendicularly connected to the first radiating section, the first radiating path and the second radiating path form a rectangular frame.

3. The multiband antenna as claimed in claim 1, wherein the feeding end is formed at an end of the first radiating section.

4. The multiband antenna as claimed in claim 1, wherein the main radiating portion includes a connecting section and a bent section, the bent section is connected to the first and second radiating path by the connecting section.

5. The multiband antenna as claimed in claim 4, wherein the connecting section includes a first connecting strip extended from the third radiating section and a second connecting strip connected to the bent section; the first connecting strip and the second connecting strip are combined together.

6. The multiband antenna as claimed in claim 4, wherein the bent section is a sheet extending from the end of the connecting section along a square waveform.

7. The multiband antenna as claimed in claim 6, wherein the bent section includes two and half wave sections.

8. The multiband antenna as claimed in claim 1, wherein the transmitting section includes a first transmitting segment and a second transmitting segment, the first transmitting segment includes a first end and a first transmitting strip perpendicularly connected to the first end, the second transmitting segment includes a second transmitting strip and a second end perpendicularly connected to the second transmitting strip, the first transmitting strip is perpendicularly connected to the second transmitting strip.

9. The multiband antenna as claimed in claim 8, wherein the second end is collinear with the fourth radiating section, and forms a gap with the fourth radiating section.

10. The multiband antenna as claimed in claim 8, wherein the ground end is formed at the second end, and opposite to the feed end.

11. A multiband antenna, comprising:

a feeding end;

a ground end; and a main body, comprising:

a first radiating path;

a second radiating path;

a main radiating portion, the first and second radiating paths connected between the feed end and the main radiating portion; and a transmitting portion connected to the main radiating portion and the ground end; wherein the first and second radiating paths, the main radiating portion, and the transmitting portion are coplanar.

12. The multiband antenna as claimed in claim 11, wherein the first radiating path includes a first radiating section and a second radiating section perpendicularly connected to the first radiating section; the second radiating path includes a third radiating section and a fourth radiating section perpendicularly connected to the third radiating section.

13. The multiband antenna as claimed in claim 12, wherein the second radiating section is perpendicularly connected to the third radiating section, the fourth radiating section is perpendicularly connected to the first radiating section, the first radiating path and the second radiating path form a rectangular frame.

14. The multiband antenna as claimed in claim 11, wherein the main radiating portion includes a connecting section and a bent section, the bent section is connected to the first and second radiating path by the connecting section.

15. The multiband antenna as claimed in claim 14, wherein the connecting section includes a first connecting strip extended from the third radiating section and a second connecting strip connected to the bent section; the first connecting strip and the second connecting strip are combined together.

16. The multiband antenna as claimed in claim 14, wherein the bent section is a sheet extending from the end of the connecting section along a square waveform.

17. The multiband antenna as claimed in claim 11, wherein the transmitting section includes a first transmitting segment and a second transmitting segment, the first transmitting segment includes a first end and a first transmitting strip perpendicularly connected to the first end, the second transmitting segment includes a second transmitting strip and a second end perpendicularly connected to the second transmitting strip, the first transmitting strip is perpendicularly connected to the second transmitting strip.

18. A multiband antenna, comprising:

a feeding end;

a ground end; and a main body, comprising:

a first and second radiating paths;

a main radiating portion; and a transmitting portion; wherein the first and second radiating paths, the main radiating portion and the transmitting portion are coplanar; the feed end, the first radiating path, the main radiating portion, the transmitting portion, and the ground end are orderly connected; the feed end, the second radiating path, the main radiating portion, the transmitting portion, and the ground end are orderly connected.

19. The multiband antenna as claimed in claim 18, wherein the first radiating path includes a first radiating section and a second radiating section perpendicularly connected to the first radiating section; the second radiating path includes a third radiating section and a fourth radiating section perpendicularly connected to the third radiating section.

20. The multiband antenna as claimed in claim 19, wherein the second radiating section is perpendicularly connected to the third radiating section, the fourth radiating section is perpendicularly connected to the first radiating section, the first radiating path and the second radiating path form a rectangular frame.

* * * * *